US006683405B2

(12) United States Patent
Carter

(10) Patent No.: US 6,683,405 B2
(45) Date of Patent: Jan. 27, 2004

(54) FLUORESCENT CWX LAMP WITH REDUCED MERCURY

(75) Inventor: Brett A. Carter, Salina, KS (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 188 days.

(21) Appl. No.: 09/891,431

(22) Filed: Jun. 26, 2001

(65) Prior Publication Data

US 2003/0006694 A1 Jan. 9, 2003

(51) Int. Cl.[7] ..... H01J 63/04

(52) U.S. Cl. ..... 313/486; 313/485; 313/487; 313/484; 252/301.4 B; 252/301.4 F; 252/301.6 S; 252/301.6 R

(58) Field of Search ..... 313/485, 486, 313/484, 487; 252/301.4 B, 301.4 F, 301.6 S, 301.6 R

(56) References Cited

U.S. PATENT DOCUMENTS 4,079,287 A * 3/1978 Soules et al. ..... 313/487
4,357,559 A * 11/1982 Piper ..... 315/248
5,753,999 A * 5/1998 Roozekrans et al. ..... 313/489
5,869,927 A * 2/1999 Matsuo et al. ..... 313/485
5,898,265 A * 4/1999 Woodward et al. ..... 313/486
6,049,164 A * 4/2000 Van Kemenade et al. .. 313/492
6,472,812 B2 * 10/2002 Vose et al. ..... 313/486

* cited by examiner

*Primary Examiner*—Ashok Patel
*Assistant Examiner*—Holly Harper
(74) *Attorney, Agent, or Firm*—Frank Keegan

(57) ABSTRACT

An electric lamp has an envelope with an inner surface and two electrodes located at each end of the envelope. The electrodes transfer electric power to generate ultraviolet radiation in the envelope which is filled with mercury and a charge sustaining gas. The inner surface of the envelope is pre-coated with an aluminum oxide layer to reflect ultraviolet radiation back into the envelope. A phosphor layer is formed over the aluminum oxide to convert the ultraviolet radiation to visible light. The phosphor layer is a mixture of four phosphors, namely, blue-luminescing Blue Halophosphate (BH), red-luminescing Yittrium Oxide (YOX), 2900K-luminescing Calcium Halophosphate, also referred to as Warm White Halophosphate (WW), and green-luminescing Zinc Silicate (ZS).

15 Claims, 2 Drawing Sheets

FLUORESCENT CWX LAMP WITH REDUCED MERCURY

BACKGROUND OF THE INVENTION

1. Field of the Invention

The present invention is directed to low pressure mercury vapor lamps, more commonly known as fluorescent lamps, having a lamp envelope with phosphor coating, and more particularly, to a coating with four phosphors over an alumina pre-coat.

2. Discussion of the Prior Art

Low pressure mercury vapor lamps, more commonly known as fluorescent lamps, have a lamp envelope with a filling of mercury and rare gas to maintain a gas discharge during operation. The radiation emitted by the gas discharge is mostly in the ultraviolet (UV) region of the spectrum, with only a small portion in the visible spectrum. The inner surface of the lamp envelope has a luminescent coating, often a blend of phosphors, which emits visible light when impinged by the ultraviolet radiation. Special fluorescent lamps known as cool white deluxe (CWX) have high color rendering and simulate natural light. CWX lamps are used in places where it is desired to simulate natural light, such as in retail stores for clothing and furniture.

The phosphors of conventional CWX lamps are high mercury consumers and cannot pass the Toxicity Characteristic Leaching Procedure (TCLP) test without sacrificing lamp life. Accordingly, there is a drive to reduce mercury consumption in conventional CWX fluorescent lamps without a significant reduction in the lamp life or change in the color characteristics of the emitted light.

To increase efficiency and reduce mercury consumption without a significant reduction in the lamp life or change in the color characteristics of the emitted light, different blends of phosphors are used for the luminescent coating. Further, a metal oxide layer is provided between the luminescent coating and glass envelope. The metal oxide layer reflects the UV radiation back into the phosphor luminescent layer through which it has already passed for further conversion of the UV radiation to visible light. This improves phosphor utilization and enhances light output. The metal oxide layer also reduces mercury consumption by reducing mercury bound at the tubular portion of the lamp.

Desirable fluorescent lamps characteristics include high brightness and high color rendering. Conventional CWX lamps have a correlated color temperature of approximately 4100 K, with a color rendering indices (CRI) greater than 88. In particular, conventional CWX lamps are made with a two-phosphor mixture of Strontium Magnesium Orthophosphate (St. Mag), i.e., $(Sr,Mg)_3(PO_4)_2$:Sn, and Strontium Halophosphate (St. Blue), i.e., $Sr_{10}(PO_4)_6F_2$:Sb. The St. Mag is very rich in the red region of the spectrum and the St. Blue provides the conventional CWX lamp with the blue light source.

These phosphors are detrimental for mercury consumption. In particular, St. Mag is the highest consumer of mercury and its high percentage renders the conventional CWX lamps non-TCLP compliant.

Accordingly, there is a need for fluorescent CWX lamps with reduced mercury that pass TCLP without affecting characteristics thereof, such as maintaining a high CRI of greater than 88 and substantially the same correlated color temperature (CCT) or color point coordinates.

SUMMARY OF THE INVENTION

The object of the present invention is to provide fluorescent CWX lamps with high CRI and reduced mercury consumption.

The present invention accomplishes the above and other objects by providing an electric lamp having an envelope with an inner surface and at least one electrode, such as two electrodes located at both ends of the envelope tube. The electrodes transfer electric power to generate ultraviolet radiation in the envelope which is filled with mercury and a charge sustaining gas. The inner surface of the envelope is pre-coated with a metal oxide layer, such as an aluminum oxide layer, to reflect ultraviolet radiation back into the envelope.

A phosphor layer is formed over the aluminum oxide to convert the ultraviolet radiation to visible light. The phosphor layer is a mixture of four phosphors, namely, Blue Halophosphate (BH), i.e., $Ca_{10}(PO_4)_6F_2$:Sb, red-luminescing Yittrium Oxide (YOX), i.e., $Y_2O_3$:Eu, 2900K-luminescing Calcium Halophosphate, also referred to as Warm White Halophosphate (WW), i.e., $Ca_{10}(PO_4)_6(F,Cl)_2$:Sb,Mn, and green-luminescing Zinc Silicate (ZS), i.e., $Zn_2SiO_4$:Mn.

BRIEF DESCRIPTION OF THE DRAWINGS

Further features and advantages of the invention will become more readily apparent from a consideration of the following detailed description set forth with reference to the accompanying drawings, which specify and show preferred embodiments of the invention, wherein like elements are designated by identical references throughout the drawings; and in which.

DETAILED DESCRIPTION OF THE INVENTION

Figure 1:
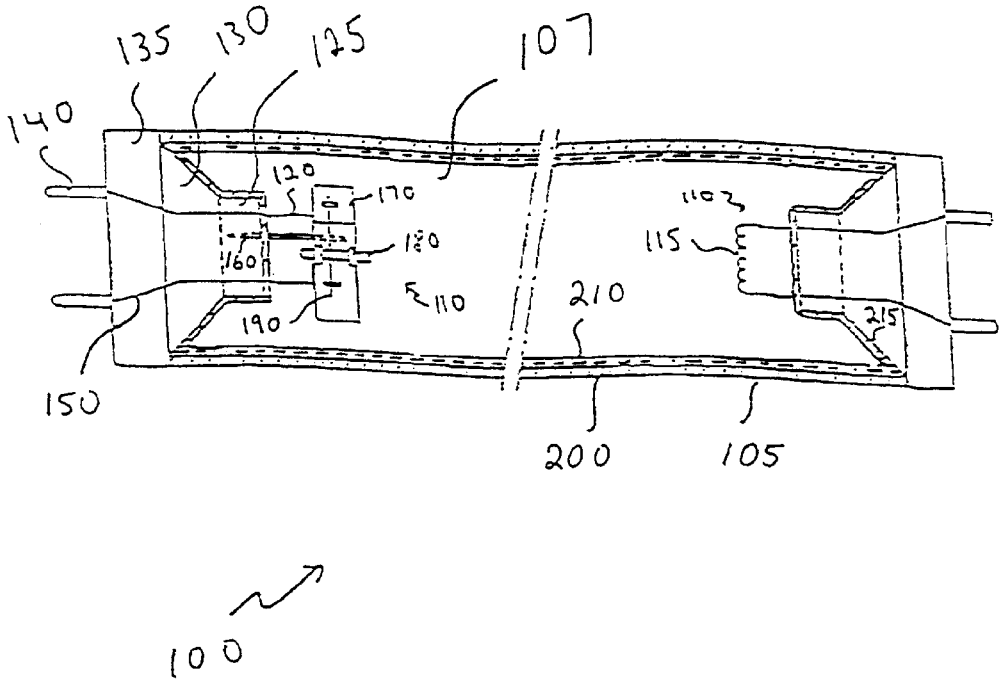
FIG. 1 shows a CWX fluorescent lamp according to present invention.

FIG. 1 shows a low-pressure mercury vapor discharge or fluorescent lamp 100 with an elongated outer envelope 105 which encloses a discharge space 107 in a gastight manner. The lamp 100 shown in the illustrative example of FIG. 1 is tubular lamp, preferably having a length of approximately 0.5 to 8 feet long, operating on a current from approximately 0.160 to 1.500 Amps, and a lamp power approximately from 4.0 to 215 Watts, for example. However, the lamp may be a compact fluorescent lamp, and the lamp may have other operating parameters and have other shapes like curved shapes, such as U-shape or circular, or any other desired shape.

Illustratively, the lamp 100 has a conventional electrode structure 110 at each end which includes a filament 115 made of tungsten, for example. Alternatively, the electrode structure 110 may be provided at only a single end, particularly for compact fluorescent lamps. The electrode structure 110 is not the essence of the present invention, and other structures may be used for lamp operation to generate and maintain a discharge in the discharge space 107. For example, a coil positioned outside the discharge space 107 may be used to generate an alternating magnetic field in the discharge space for generating and maintaining the discharge.

Returning to the illustrative lamp 100 of FIG. 1, the filament 115 of the electrode structure 110 is supported on conductive lead wires 120 which extend through a glass press seal 125 located at one end of a mount stem 130 near the base 135 of the lamp 100. The leads 120 are connected to pin-shaped contacts 140 of their respective bases 135 fixed at opposite ends of the lamp 100 though conductive feeds 150.

A center lead wire 160 extends from each mount 130 through each press seal 125 to support a cathode ring 170 positioned around the filament 115. A glass capsule 180 with which mercury was dosed is clamped on the cathode ring 170 of only one of the mounts 130. The other mount does not contain a mercury capsule, however a cathode guard 170 may be provided around its filament 115, which has been omitted in FIG. 1 in order to show the filament 115.

A metal wire 190 is tensioned over the mercury glass capsule 180. The metal wire 190 is inductively heated in a high frequency electromagnetic field to cut open the capsule 180 for releasing mercury into the discharge space 107 inside the envelope 105.

The discharge space 107 enclosed by the envelope 105 is filled with an ionizable discharge-sustaining filling which includes an inert gas such as argon, or a mixture of argon and other gases, at a low pressure. The inert gas and a small quantity of mercury sustain an arc discharge during lamp operation. In the operation of the lamp 100, when the electrodes 110 are electrically connected to a source of predetermined energizing potential via the contact pins 150, a gas discharge is sustained between the electrodes 110 inside the envelope 105. The gas discharge generates ultraviolet (UV) radiation which is converted to visible light by a phosphor luminescent layer shown as numeral 210 in FIG. 1.

In particular, the inner surface of the outer envelope 105 is pre-coated with a single layer of a metal oxide, such as aluminum oxide $Al_2O_3$ 200, over which a phosphor luminescent layer 210 is formed. The alumina pre-coat 200 reflects the UV radiation back into the phosphor luminescent layer 210 through which it has already passed for further conversion of the UV radiation to visible light. This improves phosphor utilization and enhances light output. The alumina pre-coat 200 also reduces mercury consumption by reducing mercury diffusion into the glass lamp envelope 105. To further reduce mercury consumption, the glass mount stems 130 and press seals 125 may also be coated with an alumina pre-coat layer 215, to reduce mercury bound to the glass mount stems 130 and press seals 125.

The alumina pre-coat layer 200 is applied by liquid suspension according to commonly employed techniques for applying phosphor layers on the inner surface of the lamp envelope 105. For example, aluminum oxide is suspended in a water base solution and flushed down the lamp tube or envelope 105 to flow over the envelope inner surface until it exits from the other end. The solution is dried in a drying chamber and then the phosphor coat 210 is applied in a similar fashion and sintered or baked for a period of time.

The alumina pre-coat layer 215 may be formed over the glass mount stems 130 and press seals 125 by methods well known in the art, such as by painting the glass mount stems 130 and press seals 125 with the water solution containing suspended aluminum oxide, followed by drying and sintering.

The phosphor coat 210 comprises a mixture of four phosphors. The four phosphor mixture consists of Blue Halophosphate (BH) activated by Sb, i.e., $Ca_{10}(PO_4)_6F_2$:Sb, red-luminescing Yittrium Oxide (YOX) activated by Eu, i.e., $Y_2O_3$:Eu, 2900K-luminescing Calcium Halophosphate, also referred to as Warm White Halophosphate (WW) activated by Sb, Mn, i.e., $Ca_{10}(PO_4)_6(F,Cl)_2$:Sb,Mn, and green-luminescing Zinc Silicate (ZS) activated by Mn, i.e., $Zn_2SiO_4$:Mn.

Table 1 shows the particular composition of the four phosphor mixture of the CWX fluorescent lamp according to the present invention, referred to as CWX-1, in comparison to the conventional CWX fluorescent lamp which has a two phosphor mixture, given as approximate weight percentages. Both the conventional and inventive CWX fluorescent lamps have a CRI greater than 88 and a correlated color temperature (CCT) in degree Kelvin of approximately 4100 k.

TABLE 1

| Lamp | Phosphors | Weight % |
|---|---|---|
| Conventional | St. Mag | 45.0 |
| CWX | St. Blue | 55.0 |
| CWX-1 | BH | 32.8 |
| | YOX | 27.6 |
| | WW | 31.7 |
| | ZS | 7.9 |

Table 2 shows the 100 hour photometry results for four CWX test samples of the inventive CWX fluorescent lamp referred to as test CXW-1 to test CWX-4, and four conventional CWX lamps, referred to as control CXW-1 to control CWX-4, with the two-phosphor mixture shown in Table 1. Columns 2 and 3 show the X and Y color point coordinates; column 4 shows the color rendering indices (CRI) which are related to the correlated color temperature (CCT); and column 5 shows the lumens values.

The inventive test CWX lamps were made with 5.0 grams of the four-phosphor mixture shown in table 1, over 250 mg PC, where PC is the precoat aluminum oxide layer shown in FIG. 1 as reference numeral 200, while the conventional control CWX lamps were made with 6.5 grams of the two-phosphor mixture shown in table 1.

The inventive CWX fluorescent lamp with the four-phosphor mixture exhibits higher lumens than the conventional control CWX lamps with the two-phosphor mixture. As shown in Table 2, the inventive test CWX fluorescent lamps provide superior lumen performance of approximately 2652 lumens, compared to approximately 2026 lumens for the conventional control CWX lamps. Further, the inventive test CWX lamps require only approximately 5 mg of mercury, compared to approximately 16 mg of mercury for the conventional control CWX lamps.

TABLE 2

| Lamp | X | Y | CRI | Lumens 100 hrs |
|---|---|---|---|---|
| Inventive Cool White Deluxe | | | | |
| Test CWX-1 | .3772 | .3737 | 89 | 2642 |
| Test CWX-2 | .3777 | .3741 | 89 | 2664 |
| Test CWX-3 | .3775 | .3737 | 89 | 2665 |
| Test CWX-4 | .3776 | .3735 | 89 | 2636 |
| Average | .3775 | .3737 | 89 | 2652 |
| Conventional Cool white Deluxe | | | | |
| Control CWX-1 | .3781 | .3700 | 91 | 2027 |
| Control CWX-2 | .3780 | .3698 | 91 | 2020 |
| Control CWX-3 | .3776 | .3698 | 91 | 2042 |
| Control CWX-4 | .3780 | .3702 | 91 | 2015 |
| Average | .4420 | .3603 | 91 | 2026 |

Figure 2:
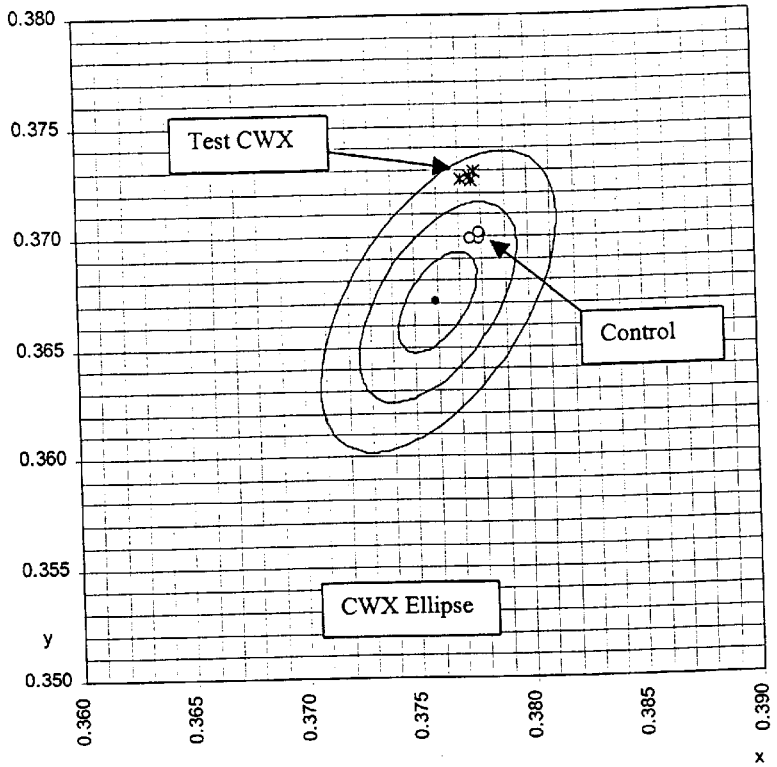
FIG. 2 shows the color acceptance criteria for the CWX fluorescent lamp according to present invention.

FIG. 2 shows the color acceptance criteria for the inventive test CWX and conventional control CWX fluorescent lamps. As shown in FIG. 2 and Table 2, the average XY color coordinate of inventive test CWX lamp is 0.3775, 0.3737, which is acceptable as it falls within the outermost ellipse of a three-step ellipse CWX color acceptance criteria shown in FIG. 2.

The inventive CWS lamp simulates natural light similar to the conventional CWX lamps, where both lamps have high CRIs with similar color coordinate and thus similar CCTs of approximately 4100 k. However, the inventive CWX lamp has reduced mercury and higher lumen output.

Figure 3:
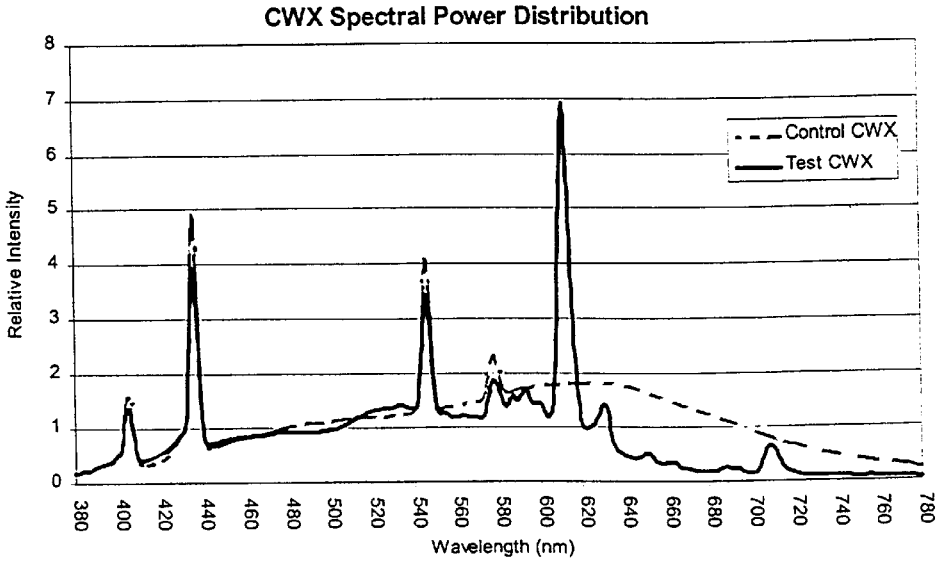
FIG. 3 shows the emission spectrum of the CWX fluorescent lamp according to the present invention.

FIG. 3 shows the emission spectrum of the inventive test CWX fluorescent lamp in a solid line, and the emission spectrum of the conventional cool white control CWX fluorescent lamp in dashed lines.

The four-phosphor mixture of the inventive CWX lamp allows the lamp 100 to have reduced mercury consumption in conjunction with the alumina pre-coat 200 which shields the glass envelope 105 from mercury. In addition to the alumina pre-coat 200, the phosphor layer 210 provides lower mercury consumption than other phosphors, as well as increased brightness.

The increased brightness and reduced mercury consumption is achieved by replacing the phosphor layer of a conventional lamp with a layer of the four-phosphor mixture layer over the UV alumina pre-coat layer. In particular, the lamps used to obtain the 100-hour photometry results shown in Table 2 were F40T12, which are straight tubular lamps having a length of 4 feet. The raw phosphor weight used in the conventional CWX lamps was approximately 6.5±0.3 g. By contrast, the weight of the four-phosphor mixture layer 210 is considerably lower, such as approximately 5.0±0.2 g. Thus, the inventive lamps have a phosphor weight of approximately 1.2 to 1.3 grams per foot. The weight of the alumina pre-coat layer 200 is approximately 250 mg.

Conventional 4 ft CWX lamps are manufactured with approximately 15–40 mg of mercury. By contrast, the inventive CWX lamps with the four phosphor mixture having a length of 4 ft and a lamp life of 20,000 hours, require less than 15 mg, namely approximately 3 mg to 8 mg for lamps having a length of 8 feet or less, such as approximately 4.4 mg of mercury for 4 foot lamps, and still maintain high lumens output as listed in table 2, namely approximately 2650 lumens. Thus, the inventive lamps have approximately 1.0 to 1.1 mg of mercury per foot.

The increased light output and reduced mercury consumption are due to the superior components of the phosphor 210, as well as the UV pre-coat layer 200 which reduces the interaction of mercury ions with the glass envelope 105 and reflects the UV rays more efficiently back into the phosphor layer 210 to improve utilization of the phosphor and enhance visible light production.

While the present invention has been described in particular detail, it should also be appreciated that numerous modifications are possible within the intended spirit and scope of the invention. In interpreting the appended claims it should be understood that:

a) the word "comprising" does not exclude the presence of other elements than those listed in a claim;

b) the word "consisting" excludes the presence of other elements than those listed in a claim;

c) the word "a" or "an" preceding an element does not exclude the presence of a plurality of such elements.

d) any reference signs in the claims do not limit their scope; and e) several "means" may be represented by the same item of hardware or software implemented structure or function.

What is claimed is:

1. An electric lamp comprising:

an envelope having an inner surface and enclosing a discharge space filled with mercury;

at least one electrode for generating ultraviolet radiation in said discharge space; and a phosphor layer formed over said inner surface to convert said ultraviolet radiation to visible light;

wherein said phosphor layer is formulated to provide an output of approximately 2650 lumens, at a color temperature of approximately 4100K; and, wherein said phosphor layer consists of blue halophosphate, yttrium oxide, calcium halophosphate, and zinc silicate.

2. The electric lamp of claim 1, wherein said mercury has a weight of less than 15 mg.

3. The electric lamp of claim 1, wherein said mercury has a weight of approximately 1.0 to 1.1 mg/ft.

4. The electric lamp of claim 1, further comprising an aluminum oxide layer formed between said inner surface and said phosphor layer.

5. An electric lamp comprising:

an envelope having an inner surface and enclosing a discharge space filled with mercury;

at least one electrode for generating ultraviolet radiation in said discharge space; and a phosphor layer formed over said inner surface to convert said ultraviolet radiation to visible light;

wherein said phosphor layer is formulated to provide an output of approximately 2650 lumens, at a color temperature of approximately 4100° K; and, wherein said phosphor layer consists of approximately 32.8% weight of blue halophosphate, approximately 27.6% weight of yttrium oxide, approximately 31.7% weight of calcium halophosphate, and approximately 7.9% weight of zinc silicate.

6. An electric lamp comprising:

an envelope having an inner surface and enclosing a discharge space filled with mercury;

at least one electrode for generating ultraviolet radiation in said discharge space; and a phosphor layer formed over said inner surface to convert said ultraviolet radiation to visible light;

wherein said phosphor layer is formulated to provide an output of approximately 2650 lumens, at a color temperature of approximately 4100° K; and, said phosphor layer consists of blue halophosphate, yttrium oxide, calcium halophosphate, and zinc silicate, a weight of said phosphor layer being approximately 1.2 to 1.3 grams per foot.

7. An electric lamp comprising:

an envelope having an inner surface and enclosing a discharge space filled with mercury having a weight of less than 15 mg;

at least one electrode for generating ultraviolet radiation in said discharge space; and a phosphor layer formed over said inner surface to convert said ultraviolet radiation to visible light; wherein said phosphor layer is formulated to provide an output at a color temperature of approximately 4100K; and, wherein said phosphor layer consists of blue halophosphate, yttrium oxide, calcium halophosphate, and zinc silicate.

8. The electric lamp of claim 7, wherein said output is approximately 2650 lumens.

9. The electric lamp of claim 7, wherein said weight of said mercury is approximately 1.0 to 1.1 mg/ft.

10. An electric lamp comprising:

an envelope having an inner surface and enclosing a discharge space filled with mercury having a weight of less than 15 mg;

at least one electrode for generating ultraviolet radiation in said discharge space; and a phosphor layer formed over said inner surface to convert said ultraviolet radiation to visible light;

wherein said phosphor layer is formulated to provide an output at a color temperature of approximately 4100K; and, wherein said phosphor layer consists of blue halophosphate, yttrium oxide, calcium halophosphate, and zinc silicate, in percent by weight of approximately 32.84 of blue halophosphate, approximately 27.6 of yttrium oxide, approximately 1.7 of calcium halophosphate, and approximately 7.9 of zinc silicate.

11. An electric lamp comprising:

an envelope having an inner surface and enclosing a discharge space filled with mercury having a weight of less than 15 mg;

at least one electrode for generating ultraviolet radiation in said discharge space; and a phosphor layer formed over said inner surface to convert said ultraviolet radiation to visible light;

wherein said phosphor layer is formulated to provide an output at a color temperature of approximately 4100° K; and, wherein said phosphor layer consists of blue halophosphate, yttrium oxide, calcium halophosphate, and zinc silicate, a weight of said phosphor layer being approximately 1.2 to 1.3 grams per foot.

12. An electric lamp comprising:

an envelope having an inner surface;

at least one electrode for generating ultraviolet radiation within the envelope; and a phosphor layer formed over said inner surface to convert said ultraviolet radiation to visible light;

and, wherein said phosphor layer consists of approximately 32.8% weight of blue halophosphate, approximately 27.6% weight of yttrium oxide, approximately 31.7% weight of calcium halophosphate, and approximately 7.9% weight of zinc silicate.

13. The electric lamp of claim 12, further comprising mercury located within said envelope, wherein said mercury has a weight of less than 15 mg.

14. The electric lamp of claim 12, further comprising mercury located within said envelope, wherein said mercury has a weight of approximately 1.0 to 1.1 mg/ft.

15. The electric lamp of claim 12, wherein a weight of said phosphor layer is approximately 1.2 to 1.3 grams per foot.

* * * * *